US008894161B2

(12) United States Patent
Herreid, II et al.

(10) Patent No.: US 8,894,161 B2
(45) Date of Patent: Nov. 25, 2014

(54) CORNER-MOUNT ELECTRONICS CABINET

(75) Inventors: Kenneth Randall Herreid, II, Lino Lakes, MN (US); Joshua Lee Wickander, Minneapolis, MN (US)

(73) Assignee: Kendall Howard L.L.C., Chisago City, MN (US)

( * ) Notice: Subject to any disclaimer, the term of this patent is extended or adjusted under 35 U.S.C. 154(b) by 252 days.

(21) Appl. No.: 13/152,868

(22) Filed: Jun. 3, 2011

(65) Prior Publication Data

US 2012/0306335 A1 Dec. 6, 2012

(51) Int. Cl.
*A47B 81/00* (2006.01)

(52) U.S. Cl.
CPC ..... *A47B 81/002* (2013.01)
USPC ..... 312/238; 312/245; 312/223.2

(58) Field of Classification Search
CPC .. A47B 49/006; A47B 81/002; A47B 95/008; G06F 1/181
USPC ..... 312/238, 245, 265.5, 263, 223.2, 285, 312/236
See application file for complete search history.

(56) References Cited

U.S. PATENT DOCUMENTS

| | | | | | |
|---|---|---|---|---|---|
| 2,337,213 | A | * | 12/1943 | Topping, Jr. | 181/156 |
| D145,237 | S | * | 7/1946 | Thorne | D14/169 |
| 2,575,530 | A | * | 11/1951 | Reid | 312/225 |
| 2,733,887 | A | * | 2/1956 | Schmidt | 248/224.8 |
| 3,203,502 | A | * | 8/1965 | Rife | 181/156 |
| 4,286,688 | A | | 9/1981 | O'Malley | |
| 4,515,143 | A | * | 5/1985 | Jabas | 126/21 A |
| 4,699,270 | A | * | 10/1987 | Bohm | 312/107 |
| 4,728,161 | A | | 3/1988 | Murphy | |
| 4,763,579 | A | * | 8/1988 | Cibulak | 108/48 |
| 5,152,592 | A | | 10/1992 | Krayer | |
| 5,349,134 | A | * | 9/1994 | Russell | 174/492 |
| 5,460,441 | A | * | 10/1995 | Hastings et al. | 312/298 |
| 5,485,932 | A | * | 1/1996 | Romm et al. | 211/87.01 |
| 5,603,376 | A | * | 2/1997 | Hendrix | 165/104.34 |
| 5,819,958 | A | * | 10/1998 | Dement | 211/90.01 |
| 5,971,507 | A | * | 10/1999 | Peroni | 312/223.2 |
| 6,056,083 | A | | 5/2000 | Daniell | |
| 6,076,904 | A | * | 6/2000 | Shepherd et al. | 312/209 |
| 6,185,098 | B1 | * | 2/2001 | Benavides | 361/695 |
| 6,220,681 | B1 | * | 4/2001 | Swensson et al. | 312/292 |
| 6,487,080 | B2 | * | 11/2002 | Robbins et al. | 361/727 |

(Continued)

FOREIGN PATENT DOCUMENTS

| | | |
|---|---|---|
| EP | 0 517 799 B1 | 1/1998 |
| JP | 2000-312318 | 7/2000 |

OTHER PUBLICATIONS

Stands and Mounts.com, Peerless Corner Mount Adapter for 32-50 inch Flat Panel Mounts (Black or Silver) CM50, copyright 2003, 3 pages.

(Continued)

*Primary Examiner* — Hanh V Tran
(74) *Attorney, Agent, or Firm* — Merchant & Gould P.C.

(57) ABSTRACT

A cabinet for holding electronic equipment includes a first rear frame, a second rear frame, and a front frame. The second rear frame is oriented substantially orthogonal to the first rear frame. The front frame is secured to both the first rear frame and the second rear frame. The front frame includes an electronic equipment mounting element for mounting at least one of electronic equipment or a support for holding electronic equipment.

19 Claims, 6 Drawing Sheets

(56) References Cited

U.S. PATENT DOCUMENTS

| | | | | |
|---|---|---|---|---|
| 6,522,824 | B2 * | 2/2003 | Dagley et al. | 385/134 |
| 6,523,917 | B2 | 2/2003 | Twellmann | |
| 6,574,100 | B1 * | 6/2003 | Anderson | 361/679.5 |
| 6,657,861 | B2 * | 12/2003 | Irmer | 361/695 |
| 6,801,428 | B2 * | 10/2004 | Smith et al. | 361/679.48 |
| 7,516,709 | B2 * | 4/2009 | Bartel et al. | 109/70 |
| 7,559,614 | B2 * | 7/2009 | Zheng | 312/258 |
| 8,089,754 | B2 * | 1/2012 | Peng et al. | 361/679.48 |
| 2001/0036351 | A1 * | 11/2001 | Fritz | 385/135 |
| 2002/0104813 | A1 * | 8/2002 | Routhier | 211/90.04 |
| 2002/0189505 | A1 * | 12/2002 | Markofer | 108/50.01 |
| 2005/0184016 | A1 * | 8/2005 | Silverman | 211/87.01 |
| 2008/0278047 | A1 * | 11/2008 | Diemel et al. | 312/245 |
| 2010/0259145 | A1 * | 10/2010 | Martich et al. | 312/245 |

OTHER PUBLICATIONS

Yeung Investments, Standard Cabinet Dimensions Part 2: Wall Cabinets, copyright 2004-2007, 5 pages.

Apartment Therapy Unplggd—posts by ryan, How Yo: Mount a Flat Panel TV in the Corner, Oct. 10, 2008, 9 pages.

Alibaba.com, High Wall Diagonal Corner Cabinets, copyright 1999-2010, 2 pages.

Alibaba.com, Wooden Wall Corner Cabinet, copyright 1999-2010, 3 pages.

Chatsworth Products, Inc., Wall-Mount Open Systems, copyright 2010, 2 pages.

Wikipedia, 19-inch rack, dated Apr. 29, 2011, 7 pages.

* cited by examiner

CORNER-MOUNT ELECTRONICS CABINET

INTRODUCTION

Electronic equipment is increasingly common in university, private, and government laboratories and computer rooms, as well as in spaces accessible to the public (for example, schools, restaurants, airports, etc.). The more advanced electronic equipment, the type typically found in laboratories and computer rooms, may include oscilloscopes, video signal generators, waveform analyzers, analog and digital multimeters, signal generators (digital, analog, RF, and audio), servers, switches, hubs, network infrastructure devices, audio and video devices, etc. These types of equipment often include mounting brackets secured on or near the front face thereof, for securing the equipment onto racks or into cabinets. These mounting brackets typically include flanges defining a number of openings to receive screws, bolts, or other fasteners. The fasteners are used to secure the flanges to elongate mounting plates that are located proximate a front portion of the rack or cabinet.

Racks and cabinets are also used to support non-technical electronic equipment. Such equipment includes, for example, audio/visual equipment such as Blu-Ray or DVD players, consumer audio equipment, cable or satellite TV equipment, etc. Since these types of equipment typically do not include mounting flanges, they are often installed on shelves that include flanges that are secured to the mounting plates. Using racks (and especially enclosed cabinets) to mount equipment located in public spaces helps secure the equipment against tampering, damage, or theft, by keeping the devices out of reach of the public or entirely secured.

In general, existing mounting cabinets are configured as an enlarged, often enclosed box. The front wall may be at least partially clear glass or plastic to allow for observation of the equipment therein. The cabinets may be wall-mounted and hold any number of equipment units, depending on size. Wall mounting helps keep floor space clear, but makes access to the rear of the cabinet and, subsequently, the wires of the equipment, difficult.

SUMMARY

In one aspect, the technology relates to a cabinet for holding electronic equipment, the cabinet including: a first rear frame; a second rear frame oriented substantially orthogonal to the first rear frame; and a front frame secured to both the first rear frame and the second rear frame, the front frame having an electronic equipment mounting element for mounting at least one of electronic equipment or a support for holding electronic equipment. In an embodiment, the first rear frame and the second rear frame each have at least one mounting projection. In another embodiment, the cabinet includes a mounting bracket having: a first rail including a first cabinet-mounting element; and a second rail including a second cabinet-mounting element, the second rail oriented substantially orthogonal to the first rail, wherein each of the cabinet-mounting elements is adapted to mate with at least one mounting projection, and wherein each of the first rail and the second rail are adapted to be secured to a wall. In still another embodiment, the first rear frame and the second rear frame at least partially define a chamfer. In yet another embodiment, the cabinet includes a top wall secured to the first rear frame, the second rear frame, and the front frame.

In another embodiment of the above aspect, the cabinet includes a bottom wall secured to the first rear frame, the second rear frame, and the front frame. In certain embodiments, at least one of the top wall and the bottom wall defines at least one opening. In another the cabinet includes a fan mounting bracket proximate the at least one opening. In another embodiment, the cabinet includes a fan secured to the fan mounting bracket. In still another embodiment, the cabinet includes at least one door pivotably connected to the front frame. In yet another embodiment, the door at least partially includes at least one of a transparent surface and a translucent surface. In yet another embodiment, the front frame defines at least one access opening located proximate the door.

In another embodiment of the above aspect, the cabinet includes a cover for selectively covering the at least one access opening. In other embodiments, the door and/or the cover include a lock. In still another embodiment, the cabinet includes a plurality of electronic mounting elements. In yet another embodiment, there is at least one electronic mounting element secured to the front frame in a horizontal orientation.

BRIEF DESCRIPTION OF THE DRAWINGS

There are shown in the drawings, embodiments which are presently preferred, it being understood, however, that the technology is not limited to the precise arrangements and instrumentalities shown.

DETAILED DESCRIPTION

Figure 1A:
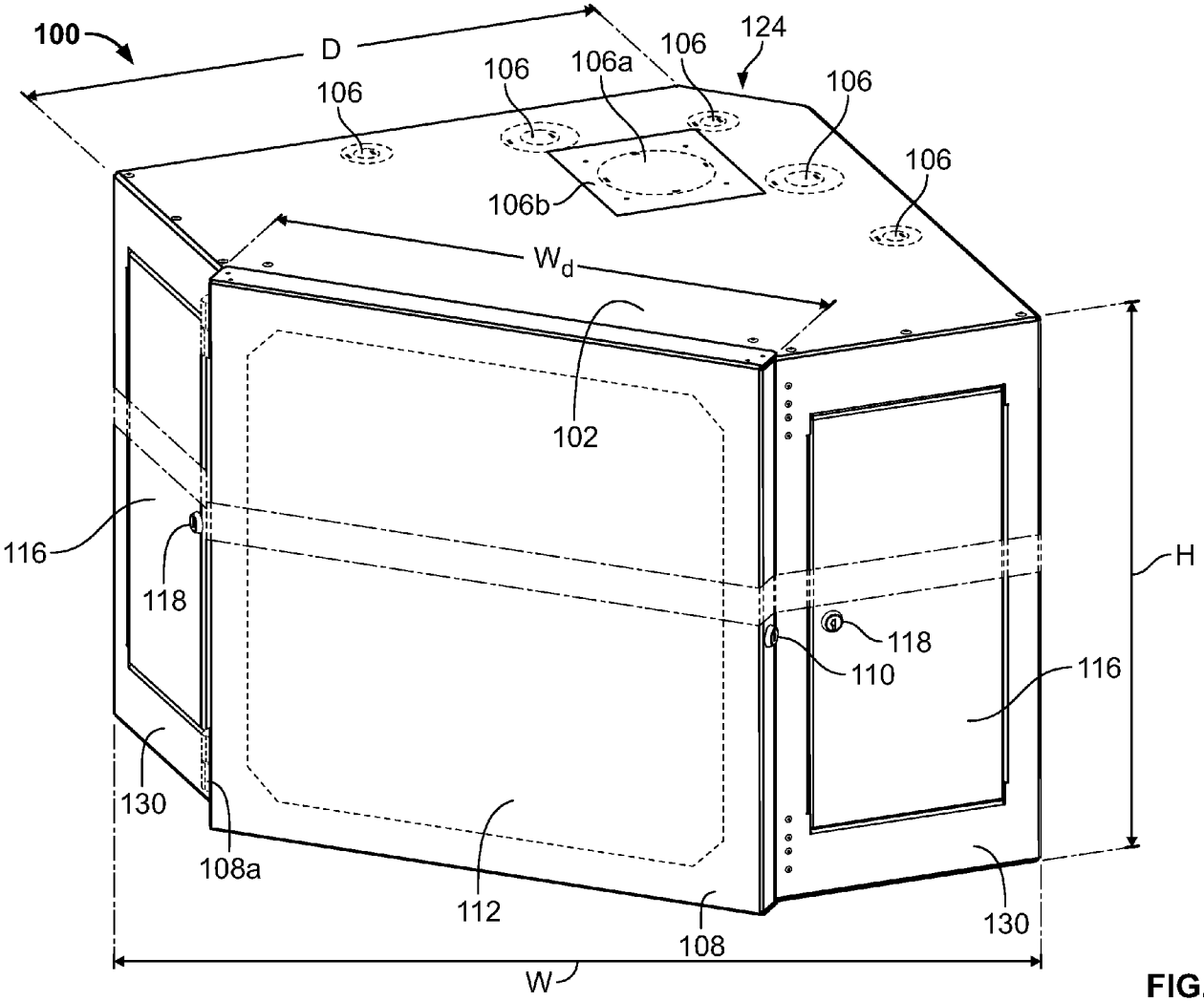
FIGS. 1A and 1B depict front perspective views of a corner-mount electronics cabinet.
Figure 1B:
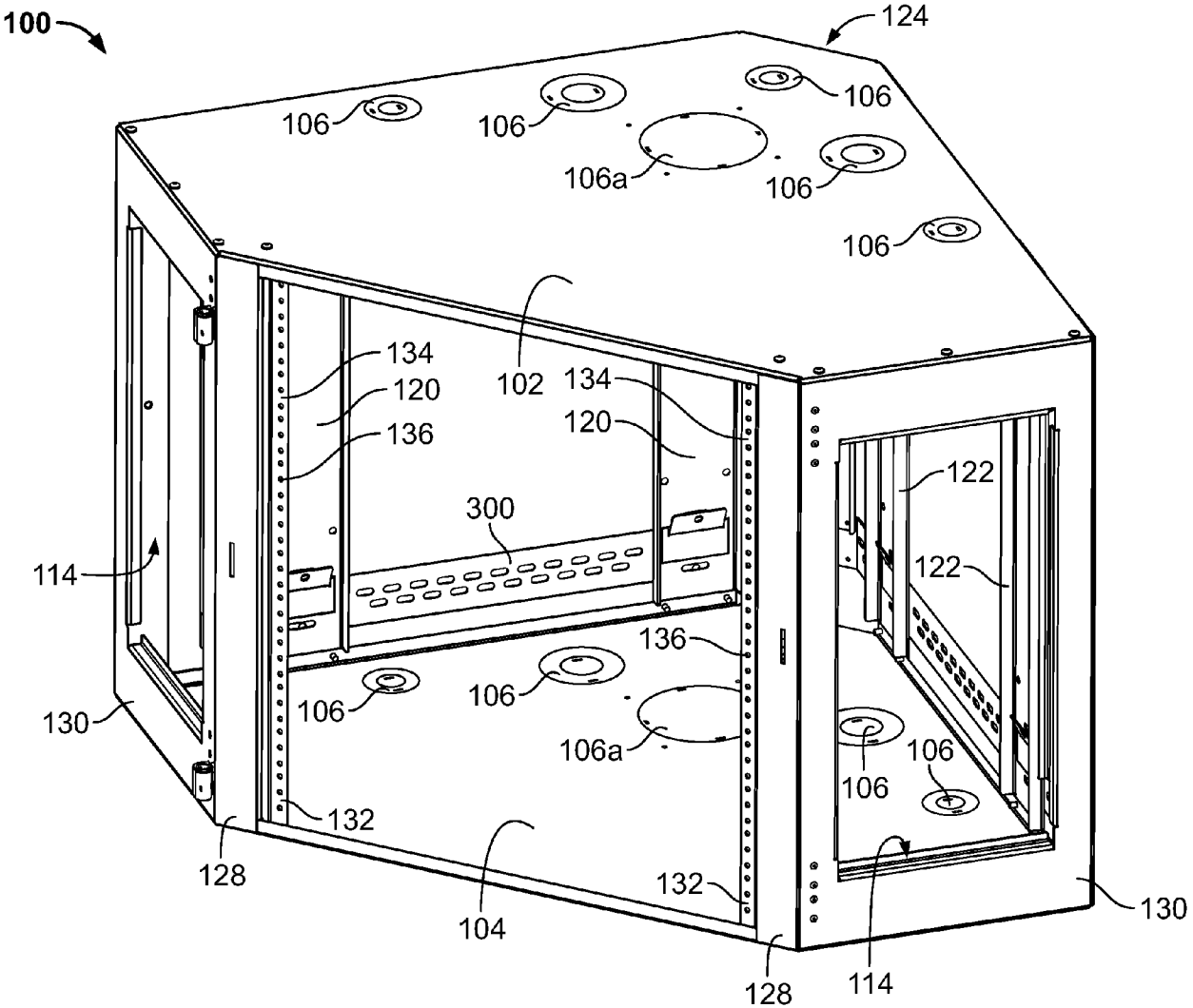
Figure 2:
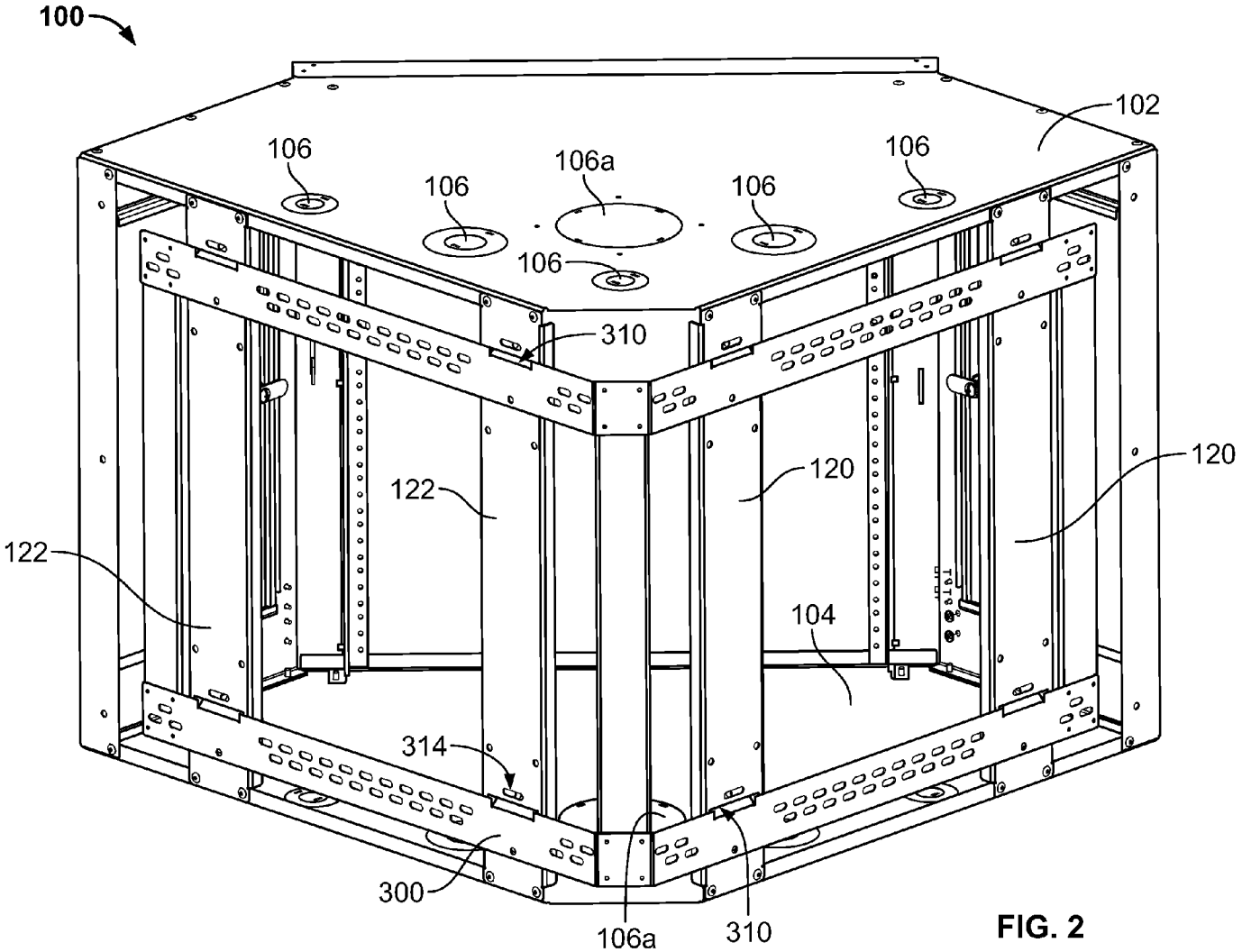
FIG. 2 depicts a rear perspective view of a corner-mount electronics cabinet.

FIGS. 1A-2 depict a corner-mount cabinet 100 for holding electronics equipment. The cabinet 100 includes a top wall 102 and a bottom wall 104 that may each define a number of knock-outs 106. The knock-outs 106 may be removed to allow for the passage of cables, power wires, etc., into the interior of the cabinet 100. Knock-outs 106 may be formed by any suitable process, such as punching or laser cutting. At least one knock-out 106*a* may be sized to allow for airflow into or out of the cabinet 100, either passively or actively using a fan. If a fan is used, a bracket 106*b* may be included to allow the fan to be mounted either internally or externally. Alternatively, the bracket need not be utilized and the fan may be attached directly to the interior or exterior of the cabinet 100 with screws, bolts, or other mechanical or chemical fasters. The cabinet 100 also includes a door 108 pivotably connected to a frame of the cabinet 100 with a hinge 108*a*. In certain embodiments, the door 108 and the hinge 108*a* may be removed and reinstalled on the opposite side, such that the door 108 may pivot in the opposite direction. A lock 110 may be included to secure the door 108 against unauthorized access to the interior. All or part of the door 108 may include a transparent or translucent element 112, such as a glass or plastic panel, to allow the interior of the cabinet 100 to be viewed from the exterior while the door 108 is closed.

The corner-mount cabinet 100 disclosed herein is particularly advantageous because it allows access to the sides and rear of the electronic equipment contained therein without removal of the equipment or dismounting of the cabinet 100 from a wall. In the depicted embodiment, access is achieved through one or more access openings 114 located on either side of the door 106. The interior of the cabinet 100 may be accessed via the access openings 114 by first removing a cover panel 116, if present. Note, the cover panel 116 may also include a lock 118 to further prevent access to the cabinet 100. Additionally, one or both of the cover panels 116 may be pivotably attached to the cabinet 100, if desired. Note that in FIG. 1B, the door 108 and cover panels 116 have been removed to expose the interior of the cabinet 100.

FIG. 2 depicts a rear perspective view of the corner-mount cabinet 100, and more clearly depicts the supporting structure. The supporting structure includes a number of horizontal and/or vertical elements that form one or more structural frames to provide support to the cabinet 100 and the equipment placed therein. The depicted embodiment includes two vertical elements 120 that together form a first rear frame and two additional vertical elements 122 that together form a second rear frame that is substantially orthogonal to the first rear frame. Each of the vertical elements 120, 122 are fixed to the top wall 102 and the bottom wall 104. If the top wall 102 and/or bottom wall 104 are not used in a particular embodiment, vertical members 120, as well as vertical members 122, may be connected by one or more horizontal members (typically proximate the top and bottom of each element 120, 122) to form the first rear frame and the second rear frame.

The first rear frame defines at least in part the first rear wall of the cabinet 100, and the second rear frame defines at least in part the second rear wall. Sheet metal or other cladding may be secured to either or both of the first rear frame and the second rear frame to close off the rear portion of the cabinet 100. Together, the two rear frames form, at least in part, a chamfer 124. The chamfer 124 is also formed in both the top wall 102 and bottom wall 104. This chamfer 124 allows the cabinet 100 to be mounted in room corners where the actual walls to which the cabinet 100 is mounted are not orthogonal. In alternative embodiments, this chamfer 124 need not be included, and the first rear frame and the second rear frame may join at a common intersection. The vertical elements 120, 122 closest to each other may define the chamfer 126, as depicted. In alternative embodiments, the chamfer 124 may be defined by one or more discrete vertical or horizontal members.

The cabinet 100 also includes one or more vertical elements 128 that form a front frame. In the cabinet embodiments depicted herein, the whole of the front frames intersect or are connected to both the first rear frames and the second rear frames. In that regard, the front frames form a substantially diagonal structure connecting the first rear frame and the second rear frame. Elements described above, such as the door 108, may be secured to these vertical elements 128. In the depicted embodiment, two access opening frames 130 that define the access openings 114 are structural members that provide additional rigidity to the cabinet 100 as well. Secured to the vertical elements 128 are a pair of equipment mounting brackets 132, proximate either side of the door 108. The equipment mounting brackets 132 include vertical rails 134 defining a number of openings 136 for receiving screws. The openings 136 are configured to match openings on brackets located on electronics equipment. In general, the electronics mounting brackets 132 may meet standards set by the Electronic Industries Alliance (EIA), the Electronic Components Association (ECA), or other standard setting organizations. In one embodiment, the electronics mounting brackets 132 are sized to receive and mount standard 19" electronics equipment. The cabinet 100 may also be used for electronic equipment that lacks such brackets. In such an embodiment, a shelf may be secured to the equipment mounting brackets 132 and the electronics equipment may be placed thereon. Such shelves are available from Kendall Howard LLC, of Chisago City, Minn.

The cabinet 100 has a height H, depth D, width W, and a door width $W_d$. The height H is, in one embodiment, the distance from a top of the cabinet 100 to a bottom of the cabinet 100. This dimension may be any height desired to accommodate any number of pieces of electronic equipment. Alternatively, a number of cabinets 100 may be installed in a stacked configuration to accommodate equipment. In such a stacked configuration, it may be advantageous to utilize cabinets lacking top walls 102 and/or bottom walls 104 so as to accommodate airflow within the cabinet. The depth D should be sufficient to accommodate anticipated electronic equipment and provide sufficient rear clearance to allow access to cables related thereto. The door width $W_d$ should be sized so as to accommodate electronic equipment. A door width $W_d$ of at least about 23" allows for installation and access of most types of electronics equipment used in laboratories and computer rooms, with desired clearance. The total width W of the unit may be at least partially dictated by the door width $W_d$, and also contemplates clearance required so as to allow access to internal electronic equipment via the access openings 114. In embodiments, H may be about 6" to about 82", D may be about 10" to about 60", W may be about 12" to about 100", and $W_d$ may be about 6" to about 50". Other cabinet embodiments having different configurations and dimensions are contemplated and are described herein.

The cabinet 100 is secured to a wall, typically in the corner of a room. The cabinet 100 may be secured directly with screws, bolts, or other fasteners inserted through elements of the frame. However, due to the weight of the cabinet 100 and the electronic equipment contained therein, securing the cabinet 100 to wall studs is desirable. However, the frame elements 120, 122 may not necessarily align with the studs. In that regard, the proposed technology also contemplates a mounting bracket 300 that may be used to secure the cabinet 100 to a wall, regardless of the location of the studs and frame elements 120, 122.

Figure 3:
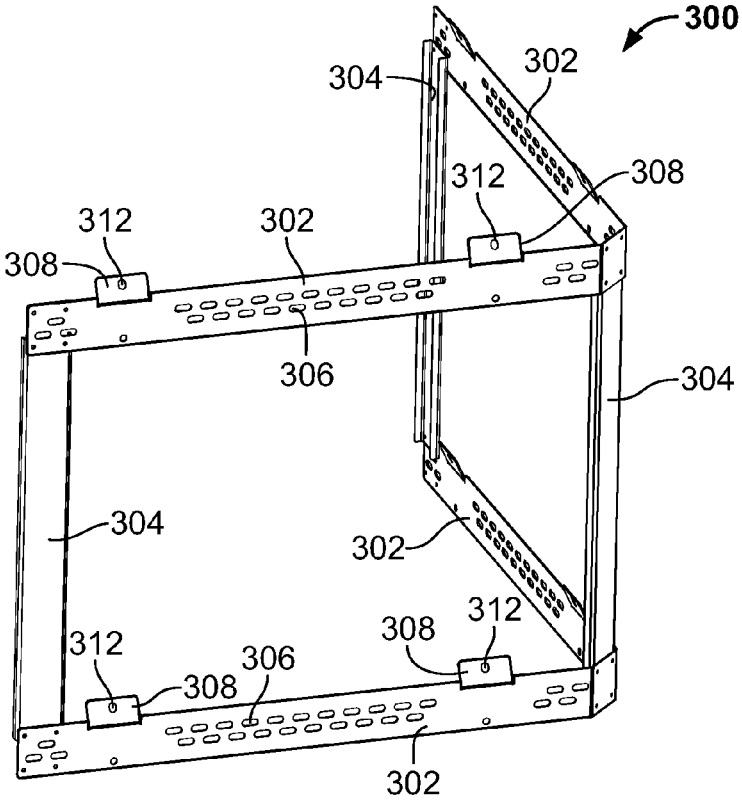
FIG. 3 depicts a perspective view of a mounting bracket for a corner-mount electronics cabinet.

FIG. 3 depicts one such mounting bracket 300. The bracket 300 includes one or more mounting rails 302 that may be either vertically or horizontally oriented. In the depicted embodiment, the mounting rails 302 are horizontally oriented and may be connected by one or more spanning rails 304 to form a single, robust mounting bracket 300. The bracket 300, in this case, includes upper and lower mounting rails 302 for securing each of the first rear frame and the second rear frame of the cabinet 100 to a corner of a wall. FIG. 2 depicts the cabinet 100 secured to the mounting bracket 300. The rails 302 define a plurality of openings 306 that accommodate screws, bolts, or other fasteners. The number of openings 306 allows the bracket 300 to be easily secured to a wall, regardless of stud location. The cabinet 100 may be secured directly to the bracket 300 with mechanical fasteners, but a potentially more desirable embodiment includes a mounting element that allows the cabinet 100 to be secured without the use of screws or bolts.

In the depicted embodiment, the mounting element includes a number of projections 308 integral with each rail 304. Of course, a lesser or greater number of projections 308 may be utilized, depending on the application. Additionally, projections 308 may only be present on the upper mounting rail 302, but locating projections 308 on each mounting rail 302 helps ensure a stable mounting. The projections 308 engage slots 310 (FIG. 2) on the vertical elements 120, 122, when the cabinet 100 is hung on the mounting bracket 300.

Openings 312 defined by the projections 308 align with openings 314 (FIG. 2) on the vertical elements 120, 122 to receive an optional mechanical fastener.

Figure 4A:
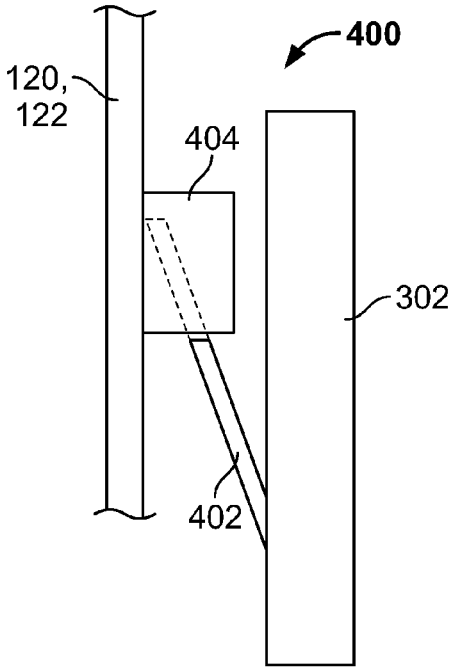
FIGS. 4A and 4B depict side views of mounting elements for a corner-mount electronics cabinet.
Figure 4B:
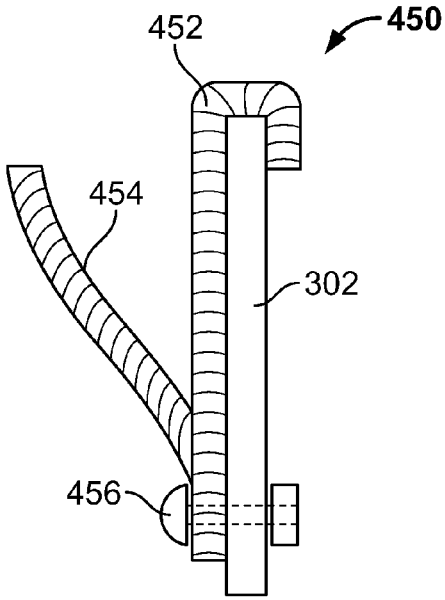

Two additional mounting element embodiments are depicted in FIGS. 4A and 4B. FIG. 4A depicts a mounting element 400 integral with the rail 302. In this embodiment, the rail 302 may include a formed or stamped tine 402 that may project from the rail 302. The tine 402 may be formed during or after manufacture of the rail 302. The tine 402 projects from the rail 302 such that it can engage with a slot or projection 404 similarly formed in one of the vertical elements 120, 122. If a projection 404 is utilized, as depicted, this too may be formed during or after manufacture of the vertical element 120, 122. FIG. 4B depicts a mounting element 450 that is not integral with the rail 302. In this case, the mounting element 450 includes a discrete hook 452 made of metal or other material. The hook 452 is hung from the rail 302 and includes an integral tine 454 that projects therefrom. The tine 454 engages a slot or projection on one of the vertical elements 120, 122, as described above with regard to FIG. 4A. The hook 452 may be further secured to the rail 302 with a screw, bolt, or other fastener 456. While the fastener 456 is not required to secure the hook 452 to the rail 302, it may desirable to help retain the hook 302 in place should the cabinet 100 be lifted from the mounting element 450. The mounting element 450 depicted in FIG. 4B may be particularly useful, since it allows the cabinet 100 to be mounted to the mounting bracket 300 without regard to alignment between the tine 454 and the slot or projection through which the tine passes. In this regard, rails 302 for mounting brackets may be manufactured and sold in lengths, cut to size in the field, and fixed to walls. Mounting elements 450 may then be secured to the rails 302 at locations that correspond to the cabinet frame element 120, 122, regardless of the depth D of the cabinet 100.

Figure 5A:
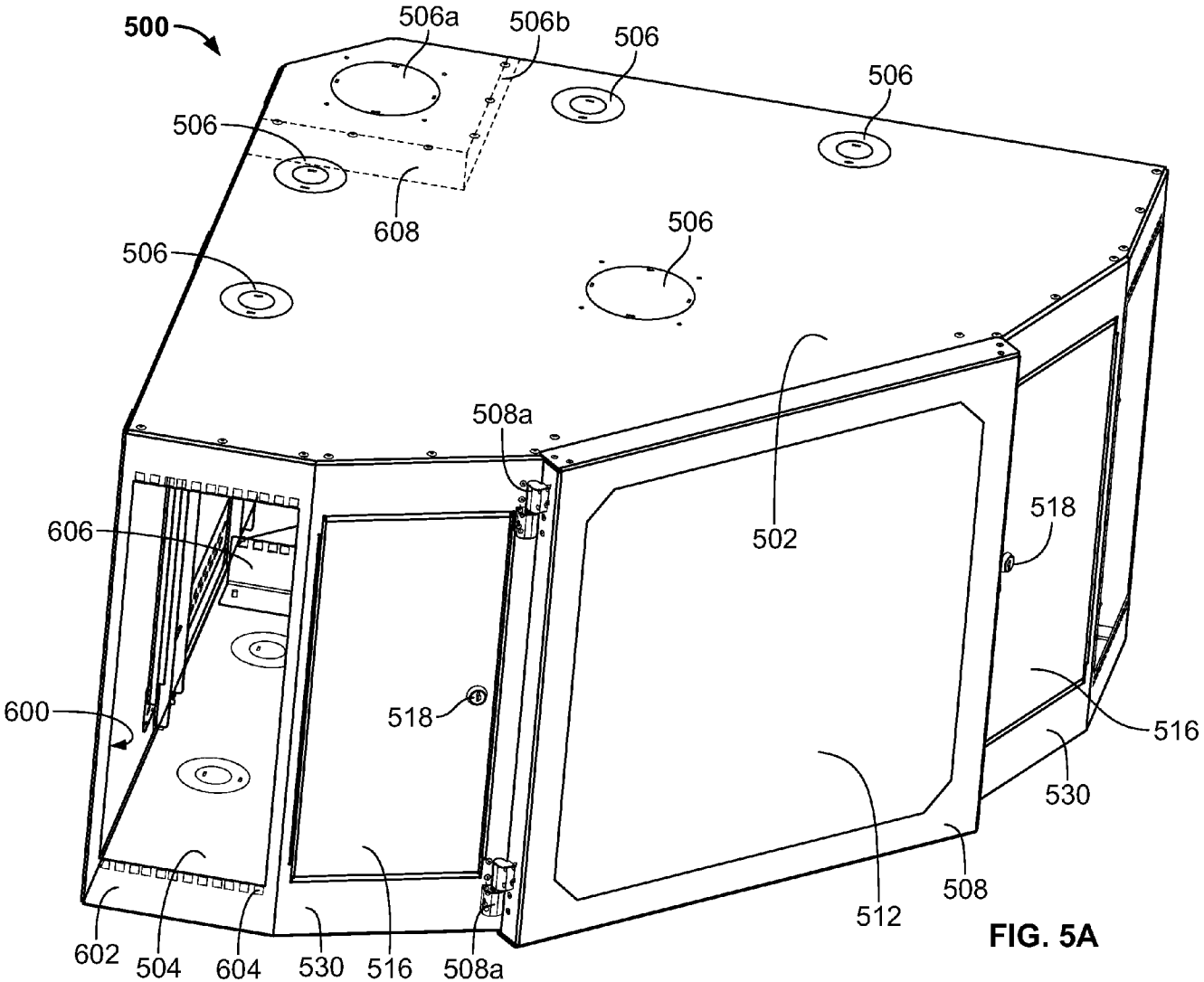
FIGS. 5A and 5B depict front perspective views of corner-mount electronics cabinets.
Figure 5B:
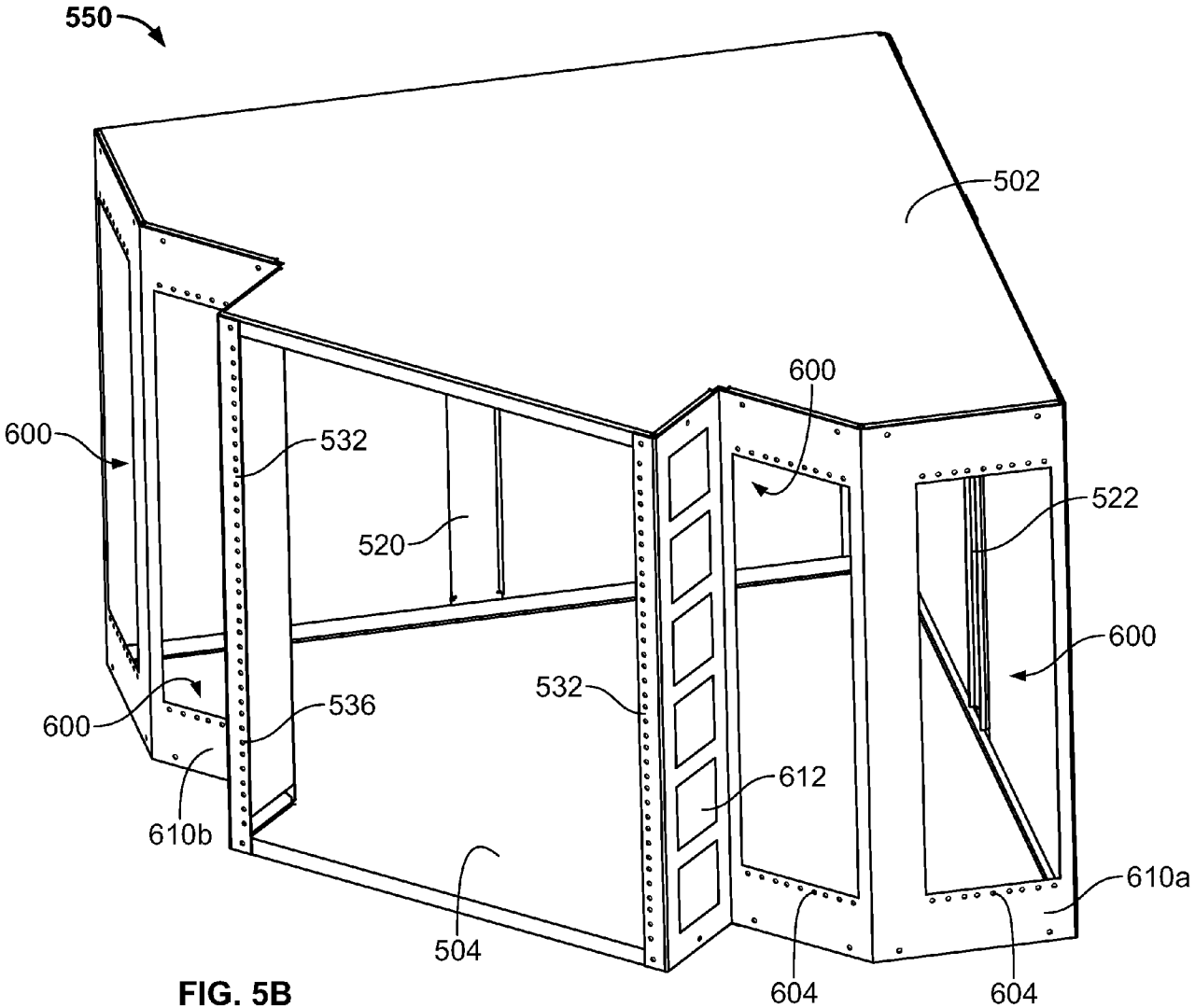

FIGS. 5A and 5B depict alternative embodiments of corner-mount cabinets. The frame structure and other elements of the cabinets 500, 550 are similar to those depicted in FIGS. 1A-2. In that regard, designators beginning with "500" identify like elements that perform similar functions, and are thus not described here. Instead, additional structure or other components, or those components that perform additional or different functions are described below. FIG. 5A depicts a corner-mounting cabinet 500, which includes two additional openings 600. These openings 600 may be used for a number of purposes, including access, ventilation, or equipment installation. If the openings 600 are used for access, covers similar to covers 516 may be utilized to prevent unauthorized access to the interior of the cabinet 500. To increase ventilation, the openings 600 may be configured with a grille or louver, and/or may be fitted with one or more fans to actively ventilate the interior. In the depicted embodiment, the frame 602 of the opening 600 includes a number of openings 604 similar to those located on the mounting brackets 132 of the embodiment depicted in FIG. 1B. Thus, the upper and lower edges of the opening 600 may function as mounting elements for electronic equipment that are vertically mounted within the cabinet 500, proximate a side thereof. A rear mounting element 606, located within the cabinet 500 may also be used to secure certain types of electronic equipment. This cabinet also includes a fan 608 fixed to the fan-mounting bracket 506*b* within the interior of the cabinet 500.

FIG. 5B depicts another embodiment of a corner-mount cabinet 550. This embodiment may not utilize doors or covers used to secure the interior of the cabinet 550. Since the equipment and wiring are therefore accessible, it would be desirable that such a cabinet 550 be installed in a secure location, such as a computer or electronics lab accessible only to authorized personnel. Similar to the embodiment depicted in FIG. 5A, the openings 600 may be used to install other electronic components (in a vertical orientation), louvers, fans, etc. The front frame sections 610*a*, 610*b* of the cabinet 550 may be manufactured of one or more discrete elements or, as depicted, may be formed in a unitary piece and folded, bent, or otherwise modified to form the front support frame for the cabinet 550. The front frame sections in addition to including the electronics mounting brackets 532, may also define a number of openings 612 proximate the electronics mounting brackets 532. These openings 612 may be used for additional ventilation (with or without louvers), decoration, etc.

The corner-mount electronics cabinets depicted herein may be manufactured of metal or plastic materials as appropriate or as desired for a particular application. Depending on the application, rolled sheet metal from about 0.020" to about 0.125" gauge steel may be desirable for particular embodiments. In certain corrosive laboratory environments, stainless steel or other non-corrosive metals may be used. The cabinet may also be finished by painting or powder-coat processes. Plexiglas or other hi-impact strength glass substitutes may also be utilized, for all or part of the construction.

While there have been described herein what are to be considered exemplary and preferred embodiments of the present technology, other modifications of the technology will become apparent to those skilled in the art from the teachings herein. The particular methods of manufacture and geometries disclosed herein are exemplary in nature and are not to be considered limiting. It is therefore desired to be secured in the appended claims all such modifications as fall within the spirit and scope of the technology. Accordingly, what is desired to be secured by Letters Patent is the technology as defined and differentiated in the following claims, and all equivalents.

What is claimed is:

1. A corner-mountable cabinet for supporting and storing rack-mountable electronic equipment, the cabinet comprising:

a first rear frame;

a second rear frame oriented substantially orthogonal to the first rear frame, wherein the first rear frame and the second rear frame at least partially define a chamfer, the first and second rear frames being configured to be corner-mountable; and a front frame secured to both the first rear frame and the second rear frame, the front frame comprising:

an equipment opening frame portion including an equipment opening substantially parallel to the chamfer, wherein a width of the equipment opening is sized to receive at least one of at least 19 inch rack-mountable electronic equipment; and an access opening frame portion including an access opening and disposed between the equipment opening and at least one of the first rear frame and the second rear frame; and electronic equipment mounting brackets supported by the equipment opening frame portion and arranged on opposite sides of the front door opening, the electronic equipment mounting brackets comprising:

a pair of rails comprising vertically extending elongate strips; and a plurality of spaced fastener openings arranged in a row in each of the pair of rails, the fastener openings extending through the vertically extending elongate strips;

wherein the pair of rails and the plurality of spaced openings are positioned in the cabinet for mounting the at least 19 inch rack-mountable electronic equipment onto the electronic equipment mounting brackets.

2. The cabinet of claim 1, wherein the first rear frame and the second rear frame each comprise at least one mounting slot.

3. The cabinet of claim 2, further comprising a wall mounting bracket comprising:

a first mounting rail comprising a first cabinet-mounting element; and a second mounting rail comprising a second cabinet-mounting element, the second mounting rail oriented substantially orthogonal to the first mounting rail, wherein each of the first and second cabinet-mounting elements is adapted to mate with at least one mounting slot, and wherein each of the first mounting rail and the second mounting rail are adapted to be secured to a wall.

4. The cabinet of claim 1, further comprising at least one cabinet wall secured to the first rear frame, the second rear frame, and the front frame.

5. The cabinet of claim 4, wherein the at least one cabinet wall defines at least one opening.

6. The cabinet of claim 5, further comprising a fan mounting bracket proximate the at least one opening.

7. The cabinet of claim 5, further comprising a fan secured proximate the at least one opening.

8. The cabinet of claim 1, further comprising at least one door pivotably connected to the front frame.

9. The cabinet of claim 8, wherein the door at least partially comprises at least one of a transparent surface and a translucent surface.

10. The cabinet of claim 8, wherein the front frame includes at least two access openings disposed on opposite sides of the door.

11. The cabinet of claim 8, wherein the front frame includes at least four access openings, including at least two access openings arranged to one side of the door and another at least two access openings arranged on an opposite side of the door.

12. A corner-mountable cabinet for supporting and storing rack-mountable electronic equipment, the cabinet comprising:

a first rear frame;

a second rear frame oriented substantially orthogonal to the first rear frame, wherein the first rear frame and the second rear frame each comprise at least one mounting slot and are configured to be corner-mountable, and wherein the first rear frame and the second rear frame at least partially define a chamfer;

a front frame secured to both the first rear frame and the second rear frame, the front frame comprising:

an equipment opening frame portion including an equipment opening substantially parallel to the chamfer, wherein a width of the equipment opening is sized to receive at least one of at least 19 inch rack-mountable electronic equipment; and an access opening frame portion including an access opening and disposed between the equipment opening and at least one of the first rear frame and the second rear frame;

electronic equipment mounting brackets supported by the equipment opening frame portion and arranged on opposite sides of the front door opening, the electronic equipment mounting brackets comprising:

a pair of rails comprising vertically extending elongate strips; and a plurality of spaced fastener openings arranged in a row in each rail of the pair of rails, the fastener openings extending through the vertically extending elongate strips;

wherein the pair of rails and the plurality of spaced fastener openings are positioned in the cabinet for mounting the at least 19 inch rack-mountable electronic equipment onto the electronic equipment mounting brackets; and a wall mounting bracket comprising:

a first rail comprising a first cabinet-mounting element; and a second rail comprising a second cabinet-mounting element, the second rail oriented substantially orthogonal to the first rail, wherein each of the first and second cabinet-mounting elements is adapted to mate with one of the at least one mounting slots, and wherein each of the first rail and the second rail are adapted to be secured to a wall.

13. The cabinet of claim 12, wherein one of the at least one mounting slots is defined by at least one of the first rear frame and a projection extending from the first rear frame.

14. A corner-mount electronics cabinet for supporting and storing rack-mountable electronic equipment therein, the corner-mount electronics cabinet comprising:

a top wall;

a bottom wall;

a rear frame extending between the top wall and the bottom wall, the rear frame including:

a first rear frame;

a second rear frame substantially orthogonal to the first rear frame; and a chamfer formed at an intersection between the first rear frame and the second rear frame;

a front frame coupled to and extending between the top wall and the bottom wall and also coupled to the rear frame, the front frame comprising:

a front door frame portion arranged substantially diagonal to the first rear frame and the second rear frame, wherein the front door frame portion defines a front door opening, wherein a width of the front door opening is sized to receive at least 19 inch rack-mountable electronic equipment; and at least one access panel frame portion adjacent to the front door frame portion;

a door hingedly coupled to the front door frame portion to move between a closed position in which the door covers the front door opening, and an open position;

electronic equipment mounting brackets coupled to the front door frame portion and arranged vertically on opposite sides of the front door opening, the electronic equipment mounting brackets including:

a pair of vertical rails formed of elongate strips of one or more materials, faces of the vertical rails being oriented toward a front of the front door opening; and a plurality of regularly spaced fastener openings arranged in a row in each of the vertical rails and extending through the vertical rails and through the faces;

wherein the pair of vertical rails and the plurality of regularly spaced fastener openings are positioned for mounting of the at least 19 inch rack-mountable electronic equipment onto the electronic equipment mounting brackets.

15. The corner-mount electronics cabinet of claim 14, wherein the electronic equipment mounting brackets conform to an Electronics Industries Association standard for cabinets configured to mount the at least 19 inch rack-mountable electronic equipment therein.

16. The corner-mount electronic cabinet of claim 15, wherein the cabinet defines an interior space, and wherein the interior space has a depth extending from the front door opening toward the rear frame, wherein the depth is sufficient to accommodate the at least 19 inch rack-mountable electronic equipment.

17. The corner-mount electronic cabinet of claim 16, wherein the depth is in a range from about 10 inches to about 60 inches.

18. The corner-mount electronic cabinet of claim 16 further comprising a height from the top of a top wall to the bottom of a bottom wall, wherein the height is in a range from about 6 inches to about 82 inches.

19. The corner-mount electronic cabinet of claim 18, wherein the width of the front door opening is sized to receive at least 19 inch rack-mountable electronic equipment and is less than about 50 inches.

* * * * *